US005718173A

United States Patent [19]

Glasbergen

[11] Patent Number: 5,718,173

[45] Date of Patent: Feb. 17, 1998

[54] STAMPING APPARATUS

[75] Inventor: Pieter Glasbergen, Voorschoten, Netherlands

[73] Assignee: B.V. Korthofah, Netherlands

[21] Appl. No.: 537,903

[22] PCT Filed: Apr. 20, 1995

[86] PCT No.: PCT/NL95/00145

§ 371 Date: Feb. 28, 1996

§ 102(e) Date: Feb. 28, 1996

[87] PCT Pub. No.: WO95/29814

PCT Pub. Date: Nov. 9, 1995

[30] Foreign Application Priority Data

May 2, 1994 [NL] Netherlands ..... 9400721

[51] Int. Cl.[6] ..... B41F 17/00

[52] U.S. Cl. ..... 101/305; 101/327

[58] Field of Search ..... 101/301, 305, 101/309, 310, 327, 333, 334, 25, 103, 108, 320

[56] References Cited

U.S. PATENT DOCUMENTS

| | | | |
|---|---|---|---|
| 4,444,108 | 4/1984 | Jenness, III | 101/305 |
| 4,566,386 | 1/1986 | Davison | 101/305 |
| 5,146,851 | 9/1992 | Anderson et al. | 101/327 |
| 5,450,793 | 9/1995 | Dobson et al. | 101/487 |
| 5,507,227 | 4/1996 | Frazer | 101/329 |
| 5,515,780 | 5/1996 | Cheever et al. | 101/299 |

FOREIGN PATENT DOCUMENTS

| | | | |
|---|---|---|---|
| 0315282 | 12/1988 | Japan | 101/305 |

*Primary Examiner*—Ren Yan

*Attorney, Agent, or Firm*—St. Onge Steward Johnston & Reens

[57] ABSTRACT

A stamping apparatus for a heat requiring ink is described wherein a stamping head is moved between an ink wetting position and an object stamping position. A stamping pad is located in a heated housing wherein a replaceable stamping pad is mounted on a rotatable spindle and wherein a metal heated casing at least partially surrounds the stamping pad to heat the ink on the stamping pad to a workable temperature. The stamping head normally is resting against the heated stamping pad to also receive heat from the metal casing and thus be able to transfer ink from the head seated against the pad to the object to be stamped. Heat from the heater in the metal casing is also transfered to a chamber where a reserve stamping pad can be stored to be preheated and thus ready for instant use when needed. A resilient pin is employed to move the rotatable stamping pad as the stamping head leaves its wetting position for stamping of an object.

10 Claims, 2 Drawing Sheets

STAMPING APPARATUS

FIELD OF THE INVENTION

The present invention relates to a stamping apparatus comprising a stamping head, a stamping pad, and a displacement mechanism for the stamping head in order to move it between a wetting position in engagement with the stamping pad and a stamping position in engagement with an object to be stamped.

BACKGROUND OF THE INVENTION

In a known stamping apparatus of this type, the permanent stamping pad is wettened from a supply container containing liquid ink. The supply container should regularly be replenished and due to the liquid ink, it regularly involves spillage which is of course cumbersome and time consuming.

Another disadvantage is that the ink is of a quick-drying type such that the stamping pad dries up even if the stamping apparatus only stops for a moment.

SUMMARY OF THE INVENTION

The object of the invention is to provide a stamping apparatus of the type mentioned in the preambe in which these disadvantages are removed in a simple but effective way.

For this purpose, these stamping apparatus according to the invention is characterized in that the stamping pad is an exchangeable disposable stamping pad impregnated with ink which is solid at room temperature and only becomes workable upon heating, the heating means are arranged for heating the stamping pad.

Such stamping pad does not lead to spillage during mounting and dismounting because the ink is solid then and the stamping pad does thus not come off. Only during heat treatment up to for example ca. 120° C., the ink becomes liquid and deliveres the ink to the stamping head. During interruption of the operation of the stamping apparatus, the heating means may be switched off leading to solidification of the ink. When the ink is heated once more, the ink becomes workable again. When the ink, which is absorbed within the stamping pad, is used, the ink pad may simply be exchanged.

The heating means may for example comprise a metal, preferably an aluminium casing having a heating element.

In this matter, the whole stamping pad may be heated uniformly with the aid of the well conducting metal casing.

A favourable embodiment of the stamping apparatus according to the invention is characterized in that the stamping head comprises a metal text holder which, in the wetting position, is lying near the heating means.

This embodiment is particularly advantageous when using very quick drying ink which can dry out even in the short time for the displacement from the wetting position to the stamping position. This is prevented by said measurements, because the metal text holder is heated by the heating means in the wetting position of the stamping head and the heat is sufficiently retained for keeping the stamping head and the ink thereon warm during the displacement to the stamping position.

It is favourable if the stamping pad is roller-shaped and the casing of the heating means being cylinder-shaped having an opening in the casing for allowing passage of the stamping head, wherein the stamping apparatus preferably comprises a drive means for rotating the roller-shaped stamping pad about the center line.

In this manner, the stamping pad is heated uniformly and the stamping pad is allowed to deliver the ink to the stamping head in a uniform way due to its rotation about the center line.

Preferably, the drive means is coupled to the displacement mechanism for the stamping head so that those separate motor or the like is necessary.

In this way, the spring pin slightly penetrates into the stamping pad in the wetting position of the stamping head and if the spring pin upon the displacement of the stamping head to the stamping position, moves from the stamping pad in a non-radial direction, the spring pin will slightly carry along the stamping pad so that the stamping pad will rotate through a small angle.

The invention will hereafter be elucidated with reference to the drawing showing two embodiments of the stamping apparatus according to the invention by way of example.

DETAILED DESCRIPTION OF THE DRAWINGS

Figure 2:
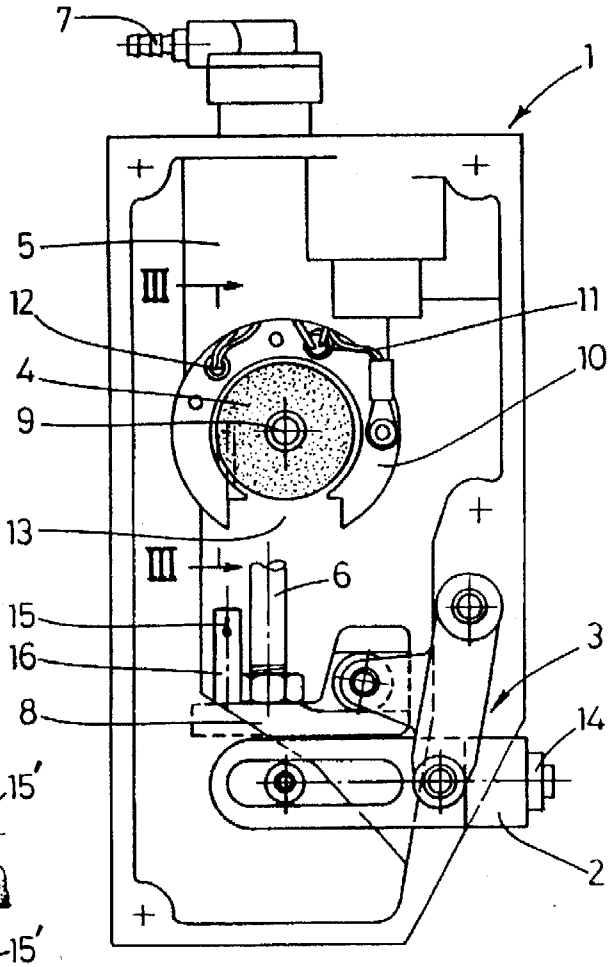
FIG. 2 is a view corresponding to that of FIG. 1, in which the stamping head, however, is in the stamping position.

The drawing illustrates a stamping apparatus comprising a housing 1 in which the various parts are housed. One of those parts is the stamping head 2 having the illustration to be stamped thereon, said stamping head 2 being displaceable by means of a displacement mechanism 3 from a wetting position in engagement with a stamping pad 4 (FIG. 1) and a stamping position (FIG. 2), in which the stamping head 2 projects out of the housing 1 in engagement with an object to be stamped, said objects may for example be packages which move by with high speed and which must be provided with an imprint or code.

The displacement mechanism 3 for the stamping head 2 is known per se and will not be discussed in detail. Through the displacement mechanism 3, the stamping head 2 is turned 90° between the wetting position and the stamping position and is moved substantially rectilinearly at the ends of the rotation so that the stamping head 2 may be contacted with the stamping pad 4 and the object to be stamped, respectively, without rotation. The drive of the displacement mechanism 3 is effected by an only partially shown pneumatic cylinder piston assembly 5 of which the end of the piston rod 6 and the air connection 7 can be recognised. The piston rod 6 moves a slide 8 of the displacement mechanism up and down, and a special arm converts the linear movement of the slide 8 into said movement of the stamping head 2. The cylinder piston assembly 5 may be of a double action type or may be provided with a spring for effecting the return movement of the piston.

As is clearly shown in the drawing, the stamping pad 4 is roller-shaped and is therefore also known an as ink roller. The stamping pad is made of a slightly resilient foam material and is impregnated with a special type of ink. The ink is solid at ambient pressure and temperature, so that the stamping pad 4 may be grasped without ink being exuded. For this reason, the stamping pad 4 may be handled without making a mess. Only upon heating the ink it becomes slightly liquid allowing the ink to be delivered to the stamping head 2.

In order to be heated, the stamping pad 4, which is rotatable about a horizontal axis 9, is surrounded by a cylindrical aluminium casing 10 which is heated by the heating element 11, the temperature of the casing 10 being controlled by means of a temperature sensor 12 and a control unit (not shown). Due to the good conductivity of the aluminium material, the whole casing 10 is uniformly heated by the heating element 11. An opening 13 in the casing 10 provides a passage for the stamping head 2 to the stamping pad 4.

In order to maintain the heating of the ink on the text or symbols of the stamping 2 also during the displacement of the stamping head from the wetting position to the stamping position, the stamping head 2 has a metal text holder 14 which is heated by the casing 10 of the heating means in the wetting position of the stamping head, the heat content of the text holder 14 allowing it to keep the ink on the stamping head 2 warm after leaving the heated casing 10. As a result the ink cannot solidify during the displacement to the stamping position.

Figure 3:
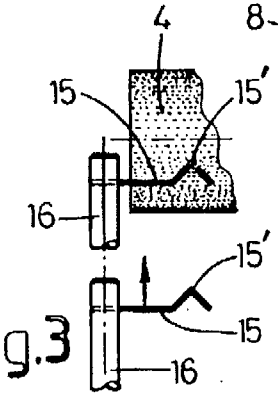
FIG. 3 illustrates in a partial view along the line III—III the operation of the drive means for the stamping pad.
Figure 1:
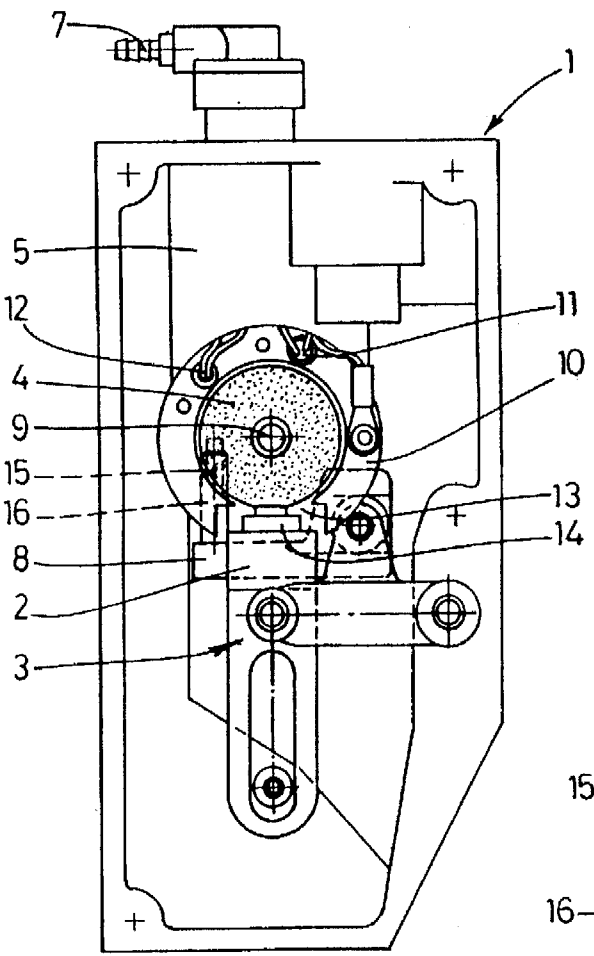
FIG. 1 is a side view of the stamping apparatus according to the invention with the stamping head in the wetting position.

In order to allow uniform delivery of ink to the stamping head 2, the stamping pad 4 is rotatable about said horizontal axis 9 by means of a drive means. In this case, the drive means consists of a thin spring pin 15 extending substantially horizontally from a support 16 which is disposed on the slide 8. The spring pin 15 moves vertically up and down at a distance from the horizontal axis 9 of the roller-shaped stamping pad. As is shown in FIGS. 1 and 3, the crest shaped part 15' of the spring pin presses slightly into the stamping pad 4 in the wetting position of the stamping head 2. When the stamping pad 4 is impressed by the spring pin 15, the stamping pad will hardly move due to the braking action by the spring pin 15 itself and the stamping head 2 pressing against the stamping pad 4. When the spring pin 15 moves away from the stamping pad 4, the non-radial movement of the spring pin 15 will lend a small acceleration to the stamping pad 4 which is not braked by the stamping head 2 and the spring pin 15 which are moved away, so that the stamping pad is rotated slightly. As a result thereof, the stamping head 2 will contact the whole circumference of the stamping pad 4. The drive of the stamping pad 4 is excellent in its simplicity because the very simple spring pin 15 is driven by the slide 8 which is part of the already present displacement mechanism 3 of the stamping head 2. The drive of the stamping pad 4 therefore requires hardly any additional parts.

Figure 4:
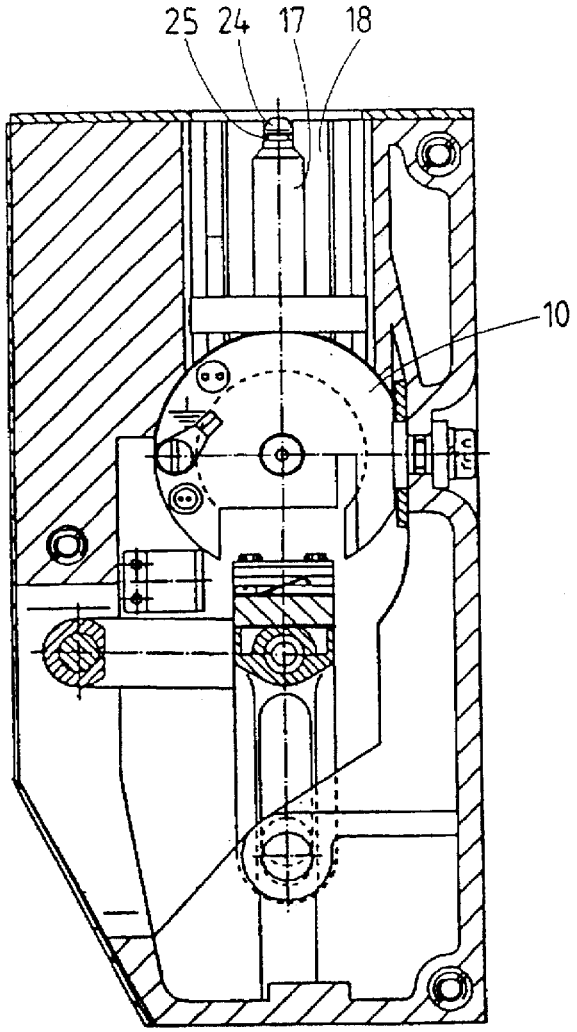
FIG. 4 illustrates a second embodiment of the stamping apparatus according to the invention, partially in sectional and partially in side view.

In FIG. 4, there is shown a second embodiment of the stamping apparatus according to the invention which is substantially the same as the stamping apparatus according to FIG. 1–3 as described. The stamping apparatus of FIG. 4 comprised a pre-heating unit for a disposable stamping pad so that the ink of a stamping pad may be pre-heated to at least the vicinity of the temperature at which the ink is workable. In the embodiment of FIG. 4 the pre-heating unit is part of the same heating means which also heat the stamping pad 4 in use. For this purpose, the aluminium casing 10 is provided with a heating pin 17 fixed thereon and allowing placement of a stamping pad. This heating pin 17 is positioned substantially centrally within a chamber 18 which is accessible through the top side of the stamping apparatus. The stamping apparatus according to FIG. 4 has the advantage that when a stamping pad has been used up, a following stamping pad, is ready for use almost immediately and no operational time is lost due to heating a new stamping pad up to the working temperature.

Figure 5:
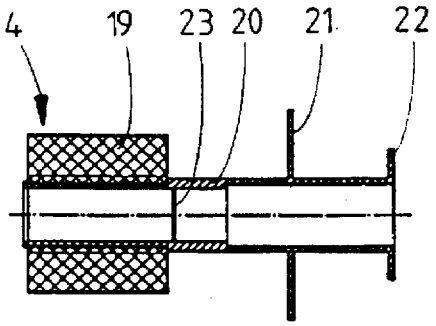
FIG. 5 is a sectional view of the disposable stamping pad of the stamping apparatus of FIG. 1 and 4.

A preferred embodiment of the stamping pad 4 is shown in a sectional view in FIG. 5. The stamping pad 4 includes an ink roller 19 mounted on an ink roller holder 20. On the side of the ink roller holder facing away from the ink roller 19, it is provided with two radially extending flanges 21 and 22 are provided. When the ink roller 19 is positioned within the casing 10 in its operational position, the flange 21 nearly fits to the outer wall of the stamping apparatus in order to close the entrance opening.

The ink roller holder 20 is constructed as a hollow pin and has on its inner side an inwardly directed rim 23 serving to lock the ink roller holder on the shaft 9 of the casing 10. The rim 23 does not have to be closed all-around and may for example consist of four lips disposed around the circumference. The shaft 9, as with the heating pin 17, comprises a conical tip 24 and a subsequent ring-shaped recess 25 in which the inner rim 23 of the ink roller holder 20 engages. In this manner, the ink roller holder 20 is locked in axial direction onto the heating pin 17 and the shaft 9 respectively, the ink roller holder remaining freely rotatable.

From the foregoing it will be clear that the invention provides a reliable stamping apparatus of which the stamping pad deliveres ink in a uniform manner, and the disposable stamping pad being replaceable by a new one simple and without messing up.

The invention is not restricted to the embodiment shown in the drawing and described herein before which may be varied in different manners within the scope of the invention.

I claim:

1. A stamping apparatus comprising:

a stamping head including a metal text holder;

a stamping pad; the stamping pad being replaceable and impregnated with an ink which is solid at room temperature and becomes workable upon heating, heating means at least partially surrounding the stamping pad for heating the stamping pad to a working temperature of the ink; and a displacement mechanism for moving the stamping head between a wetting position for engagement with said stamping pad and a stamping position for operative wetting engagement with an object to be stamped, wherein, in the wetting position, the metal text holder being located within the heating influence by said heating means for the stamping pad and being solely heated thereby so that the heated metal text holder retaining sufficient heat during its movement between the wetting and stamping positions to maintain the ink in a working condition.

2. A stamping apparatus according to claim 1, wherein the heating means comprises a metal casing having a heating element, said metal casing having an opening to allow passage of the stamping head for operative contact with the stamping pad and in proximity with the metal text holder when the stamping head is within the opening.

3. A stamping apparatus comprising:

a stamping head;

a stamping pad; the stamping pad being replaceable and impregnated with an ink which is solid at room temperature and becomes workable upon heating;

heating means for heating the stamping pad to a working temperature of the ink, wherein the heating means includes preheating means in heat conducting relationship with said heating means for storing a replacement disposable stamping pad in heat conducting relationship with said heating means for preheating of the replacement stamping pad.

4. A stamping apparatus comprising:

a stamping head;

a stamping pad; the stamping pad being replaceable and impregnated with an ink which is solid at room temperature and becomes workable upon heating;

heating means for heating the stamping pad to a working temperature of the ink, wherein the heating means includes preheating means in heat conducting relationship with said heating means for storing a replacement disposable stamping pad in heat conducting relationship with said heating means for preheating of the replacement stamping pad.

wherein said heating means includes a metal casing at least partially enclosing said stamping pad and wherein said preheating means further comprises a chamber for receiving said replacement disposable stamping pad to be heated, and a heating pin being arranged substantially centrally within the chamber and in heat conducting relationship with said metal casing with said heating pin sized to fit inside the replacement disposable stamping pad for heating thereof.

5. A stamping apparatus comprising:

a stamping head including a metal type holder;

a disposable stamping pad impregnated with ink which is solid at room temperature and becomes workable upon heating;

heating means arranged for heating the stamping pad and being located in the vicinity of a wetting position for the stamping head;

a displacement mechanism for moving the stamping head between the wetting position in engagement with the stamping pad and a stamping position for engagement with an object to be stamped wherein, in the wetting position, the metal type holder being located within the heating influence of the heating means for the stamping pad and being solely heated thereby while being in wetting contact with the heated stamping pad, whereby the thus heated metal type holder retaining sufficient heat to maintain the wetted ink on the stamping head in stamping condition.

6. The stamping apparatus according to claim 5 wherein the heating means comprises a metal casing having a heating element.

7. The stamping apparatus according to claim 6, wherein the stamping pad is roller-shaped and the metal casing of the heating means is cylindrically shaped and encloses said stamping pad, said metal casing having an opening for allowing passage of the stamping head with said metal casing being in heating relationship with said stamping head when it is in operative contact with said stamping pad at said wetting position.

8. The stamping apparatus according to claim 7, wherein said stamping pad is mounted for free rotation about an axis and further comprising drive means mounted to said stamping head for rotating the roller-shaped stamping pad when said stamping head is away from said wetting position.

9. A stamping apparatus comprising:

a stamping head including a metal text holder;

a roller shaped stamping pad; the stamping pad being replaceable and impregnated with an ink which is solid at room temperature and becomes workable upon heating.

heating means, formed of a cylindrically shaped metal casing having and enclosing a heating element and surrounding the stamping pad for heating the stamping pad to a working temperature of the ink; the metal casing having an opening for allowing passage of the stamping the head;

a displacement mechanism for moving the stamping head between a wetting position through said opening inside the metal casing and a stamping position for operative wetting engagement with an object to be stamped, wherein, in the wetting position, the metal text holder being located within the heating influence by said heating means and being heated thereby so that the heated metal text holder can retain sufficient heat during its movement between the wetting and stamping positions to maintain the ink in a working condition;

wherein said stamping pad is mounted for free rotation about an axis and further comprising drive means mounted to said stamping head for rotating the roller shaped stamping pad when said stamping head is away from said wetting position;and wherein the drive means comprises a spring pin oriented to resiliently engage the roller-shaped stamping pad at an off-axis location when said stamping head engages the stamping pad, and with the location selected so that upon disengagement of the stamping head from the roller shaped stamping pad, spring action from said spring pin forces a movement of the freely rotating stamping pad.

10. The stamping apparatus according to claim 9, wherein the spring pin is located so as to be pressed into a surface of the roller-shaped pad when the stamping head engages the stamping pad.

* * * * *